US005412840A

United States Patent [19]

Lautenschläger et al.

[11] Patent Number: 5,412,840

[45] Date of Patent: May 9, 1995

[54] ADJUSTABLE, FURNITURE HINGE HAVING SUPPORT ARM WITH EXTENSIONS ENGAGING GROOVES IN MOUNTING PLATE

[75] Inventors: Horst Lautenschläger, Reinheim; Gerhard W. Lautenschläer, Brensbach, both of Germany

[73] Assignee: MEPLA-Werke Lautenschläger GmbH & Co. KG, Germany

[21] Appl. No.: 122,529

[22] PCT Filed: Dec. 21, 1993

[86] PCT No.: PCT/EP93/00377

§ 371 Date: Sep. 28, 1993

§ 102(e) Date: Oct. 18, 1993

[87] PCT Pub. No.: WO93/21413

PCT Pub. Date: Oct. 28, 1993

[30] Foreign Application Priority Data

Apr. 8, 1992 [DE] Germany ..... 42 11 722.4

[51] Int. Cl.[6] ..... E05D 7/04

[52] U.S. Cl. ..... 16/238; 16/270

[58] Field of Search ..... 16/237, 238, 245, 246, 16/254, 270

[56] References Cited

FOREIGN PATENT DOCUMENTS

| | | |
|---|---|---|
| 2487417 | 1/1982 | France . |
| 2528329 | 7/1976 | Germany . |
| 2714082 | 11/1977 | Germany . |
| 2635237 | 2/1978 | Germany . |
| 2730940 | 1/1979 | Germany . |
| 2839576 | 3/1980 | Germany . |
| 8209266 | 7/1982 | Germany . |
| 3504790 | 8/1986 | Germany . |
| 3624965 | 2/1987 | Germany . |
| 3532650 | 3/1987 | Germany . |
| 3541110 | 5/1987 | Germany . |

*Primary Examiner*—Mark Rosenbaum
*Assistant Examiner*—Kenneth J. Hansen

[57] ABSTRACT

A furniture hinge has a door fastening member coupled via a joint mechanism to a carcase fastening member which is constructed as a support arm movably securable to a mounting member secured to the furniture carcase. Means are provided which allow the door fastening member to be vertically adjustable with respect to the carcase fastening member, even while the door fastening member is secured thereto.

11 Claims, 3 Drawing Sheets

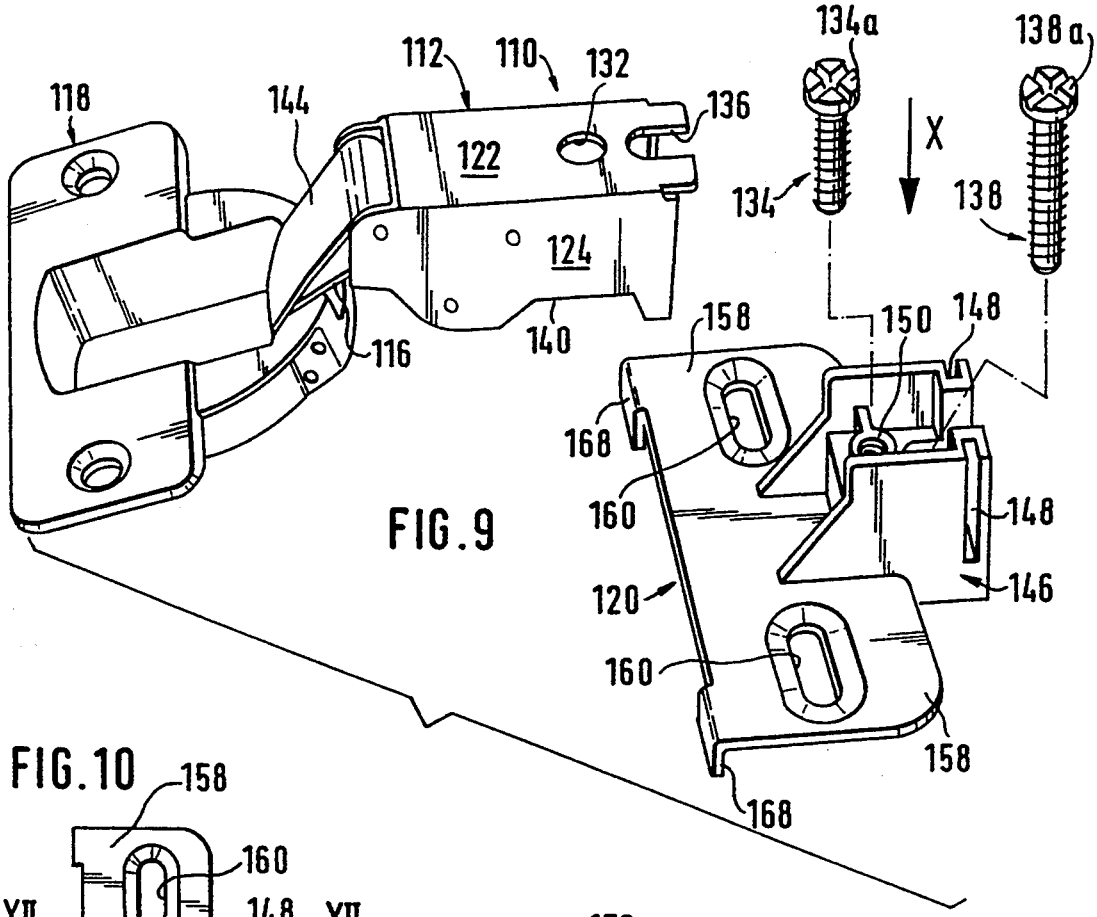
FIG.9
FIG.10
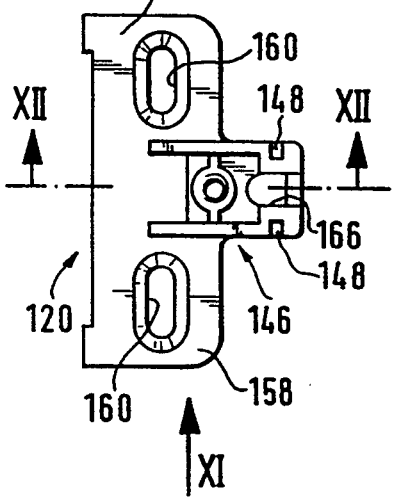
FIG.13
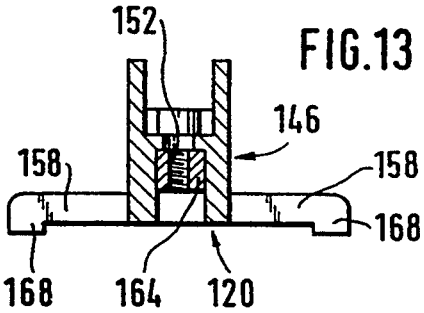
FIG.11
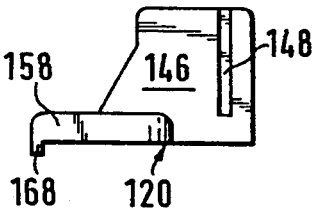
FIG.12
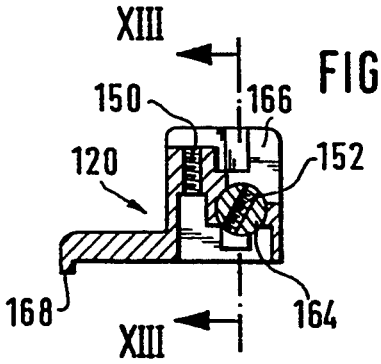

ADJUSTABLE, FURNITURE HINGE HAVING SUPPORT ARM WITH EXTENSIONS ENGAGING GROOVES IN MOUNTING PLATE

The invention relates to a furniture hinge whose door fastening member, which is constructed as an insertion cup which may be mounted sunk in a recess in the inner surface of a door of an article of furniture, is coupled via a joint mechanism to a carcase fastening member which is constructed as a support arm which is to be movably secured to a mounting member secured to the furniture carcase, is short and at least partially laterally fittingly engages over the mounting member with a U-shaped cross-section, whereby the support arm has narrow, strip-shaped corners, which are bent over substantially at right-angles towards one another from the limiting edges, which are directed away from the insertion cup and extend at right-angles to the carcase fastening surface of the mounting member, of its cheeks which laterally engage over the mounting member, which corners are slidable into a respective groove, which is provided in the mounting member and is open at the upper end directed away from the carcase, and for the purpose of adjusting the spacing of the support arm from the carcase fastening surface an adjusting screw is screwed into the mounting member, on whose free end the web surface of the support arm bears and for the purpose of fixing the support arm a fastening screw is screwed through an opening in the web surface of the support arm into the mounting member, the head of which may be screwed against the outer surface of the support arm web surface directed away from the mounting plate.

Such furniture hinges, which are also referred to as "short arm hinges" in which not only the support arm but also the mounting member used in place of the mounting plate which is commonly provided for the adjustable fastening to the cupboard carcase are significantly shortened in the longitudinal direction of the support arm with respect to normal hinges, are used, for instance, when the hinges are to be fastened not to the inner surface of the associated carcase side wall but to the narrow end face of a frame which reduces the size of the free cupboard opening. When using normal hinges the support arm and the mounting plate extend beyond the frame into the interior of the cupboard, which not only has an unattractive appearance but can also impede the removal of the contents of the cupboard. Such short arm hinges are questionable even if the mounting member holding the support arm is secured in bores of a series of bores provided in fact for bottom carriers in the immediate vicinity of the end edges of the cupboard carcase. The corners which may be slid into the grooves in the mounting member are secured against pivotal movement relative to the fastening surface on the cupboard carcase, whereby an adjustment is possible of the degree of contact or overlap of the door leaf connected to the cupboard carcase with the short arm hinges in question by altering the screwing-in depth of the adjustment screw into the mounting member and the fixing of the support arm is then possible by screwing the head of the fastening screw onto the support arm web surface. For the purpose of access to the adjusting screw there is generally provided in the web surface of the support arm an opening through which the screwdriver may be introduced for the purpose of altering the degree of contact. A further opening is then provided in the web surface for the shaft of the fastening screw. Since, with these short arm hinges, the support arm must be pushed onto the mounting member at right-angles to the carcase fastening surface during assembly, i.e. cannot be pushed, as with normal hinges, parallel to the fastening surface, the fastening screw cannot be preinstalled in the mounting member but must be pushed through the associated fastening opening in the web surface after sliding the support arm onto the mounting member and then screwed to the mounting member. This is laborious and the loose fastening screw can also be lost.

It is thus the object of the invention to develop the short arm hinges in question so that mounting of the support arm on the mounting member is possible even when the fastening screw is preinstalled in the mounting member.

Starting from a furniture hinge of the type referred to above, this object is solved in accordance with the invention if the opening through which the fastening screw passes is constructed as an elongate hole which is open at the end of the web surface which is directed away from the insertion cup and points into the interior of the cupboard, and if the length of the grooves in the mounting member, which receive the corners, and the length of the shaft of the fastening screw are so matched to one another that the fastening screw may be screwed so far out of the associated threaded bore in the mounting member, without removal, that an adequate clearance for removal of the support from the mounting member is produced between the upper side of the support arm web surface and the associated underside of the head of the fastening screw.

In an advantageous embodiment of the invention the construction can be such that the mounting member has a largest height corresponding to the largest free height of the cheeks, measured in the interior of the support arm, from their free limiting edge directed away from the web surface to the inner side of the web surface and that the upper surface of the mounting member directed towards the web surface has two vertically offset sections, whereby the threaded bore for the fastening screw opens out in the full height section and the threaded bore for the adjusting screw opens out in the other section of lesser height. If the height difference between the two sections is approximately equal to the height of the head of the adjusting screw, the latter may be screwed into the mounting member until the support arm may be screwed by means of the fastening screw until its web surface is in engagement with the section of greater height.

In a preferred embodiment of the invention the grooves in the mounting member extend only over a portion of the height of the mounting member, in that the inner lateral limiting wall of the groove further from the joint mechanism extends over the entire height of the mounting member but the outer vertical groove limiting wall nearer to the joint mechanism passes only up to about half the height and the portion lying above it of the mounting member is reduced by the removal of material from the side surfaces of the mounting member to a breadth which is substantially equal to or somewhat smaller than the unobstructed distance measured between the free limiting edges of the corners of the support arm pointing towards one another. In order to assemble the support arm, the fastening screw thus needs only to be unscrewed until the lower edge of the lateral cheeks of the support arm can be passed over the upper portion of reduced breadth of the mounting member.

The portion of reduced breadth of the mounting member can extend into the vicinity of the front end of the mounting member which points out of the interior of the carcase, whereby, however, the mounting member in this end region is conveniently broadened over its entire height to a full breadth corresponding approximately to the unobstructed distance between the cheeks of the support arm in order to brace the support arm against lateral weight forces in the predetermined mounted position against the mounting member, even in its front region close to the joint mechanism.

In a further exemplary embodiment of the invention the grooves in the mounting member can also extend over the entire height of the mounting member, whereby in the region between the grooves the mounting member has a recess which passes through to the upper surface and is open to the interior of the carcase and mounted in the lower region of the mounting member near to the fastening surface and within the recess so as to be pivotable about an axis extending at right angles to the longitudinal axis of the support arm and parallel to the carcase fastening surface there is a receiving member with a threaded bore for the shaft of the fastening screw. For the purpose of assembly and disassembly the fastening screw then needs only to be screwed out until it can be swung out of the open elongate hole.

The mounting member conveniently has flat fastening flanges projecting from its lower side surface regions close to the fastening surface in opposite directions with a respective through opening for fastening screws which may be screwed into the fastening surface. The mounting member can then be termed a wing member corresponding to the wing plates of normal hinges.

The through openings in the fastening flanges are preferably constructed as elongate holes so that the mounting member and thus the hinge secured to it is movable in the direction of the length of the elongate holes.

The elongate holes will generally extend at right angles to the central longitudinal axis of the support arm in order to render vertical adjustment possible of the door leaf connected to the carcase with the hinges in accordance with the invention. Alternatively, an arrangement of the elongate holes is, however, also possible in which they extend parallel to the longitudinal direction of the support arm, whereby gap adjustment becomes possible.

When using the furniture hinge in accordance with the invention to fasten a door leaf to a cupboard carcase narrowed by a frame, it is recommended that the fastening flanges be arranged on the front end closer to the joint mechanism of the portion of the mounting member engaging between the cheeks of the support arm and permitted to project somewhat beyond this front end, whereby then provided in the region of the front limiting edge of the fastening flanges extending at right angles to the support arm axis and on their underside directed towards the fastening surface there is a respective at least one low abutment which, in the predetermined fastened position of the mounting member, engages the carcase surface opposed to the inner surface of the closed door leaf. Thus the correct installed position of the mounting member on the associated fastening surface is ensured so that the problem of gap adjustment does not arise and also no special features need be provided for this purpose.

If the mounting member is constructed as a "wing member", the lateral cheeks of the support arm are provided with a respective cut-out on their lower edges directed away from the web surface between the vertical edges having the rear corners and the front sections carrying the pins of the joint mechanism, through which cut-out the fastening flanges can extend. The fastening flanges can then also be manufactured with a greater thickness, whereby it is possible to make them from plastics material—optionally fibre reinforced—instead of metal.

The invention will be described in more detail in the following description of two exemplary embodiments in conjunction with the drawings, in which:

FIG. 9 is a view similar to FIG. 1 of a second exemplary embodiment of the invention in which merely the mounting member is modified with respect to the first embodiment but the actual hinge is unaltered;

FIG. 10 is a plan view of the mounting member of the second embodiment, seen in the direction of the arrow 10 in FIG. 9;

FIG. 11 is a side view of the mounting member, seen in the direction of the arrow 11 in FIG. 10;

FIG. 12 is a sectional view of the mounting member, seen in the direction of the arrows 12—12 in FIG. 10; and FIG. 13 is a sectional view of the mounting member, seen in the direction of the arrows 13—13 in FIG. 12.

Figure 1:
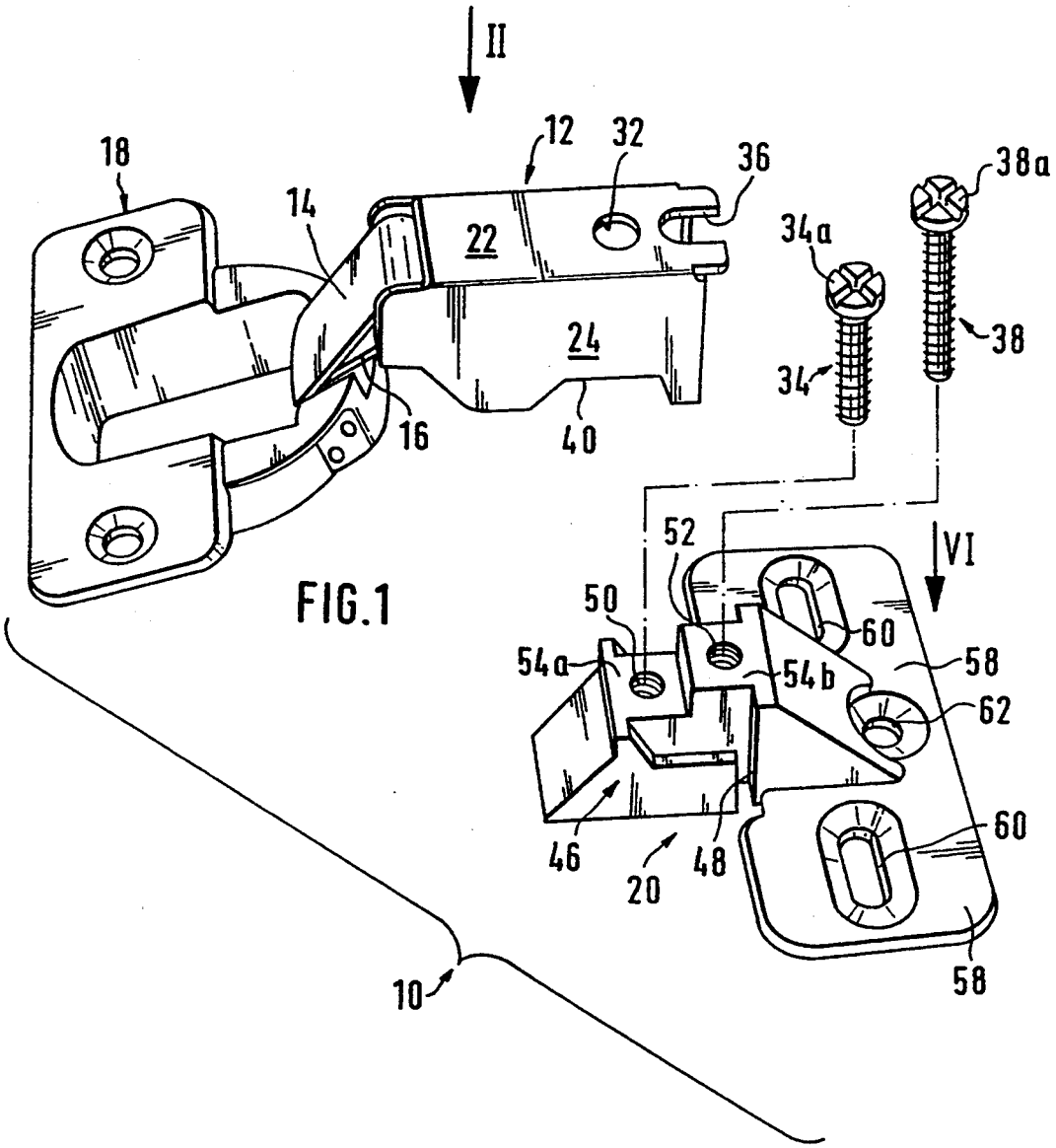
FIG. 1 is a perspective view of a first exemplary embodiment of a furniture hinge in accordance with the invention, whereby the short support arm of the actual hinge is shown in a position in which it is lifted away from the mounting member provided for the adjustable fastening to the furniture carcase and the adjusting and fastening screws are shown in unscrewed positions.
Figure 2:
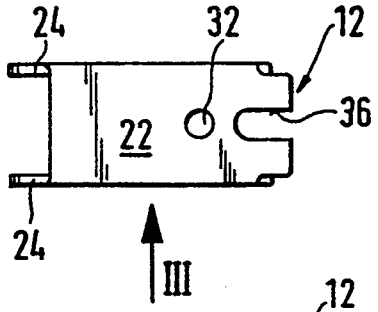
FIG. 2 is a plan view of the support arm of the exemplary embodiment shown in FIG. 1, seen in the direction of the arrow 2 in FIG. 1.

FIG. 1 shows a four joint hinge, which is designated as a whole with 10 and which pivotally connects a door leaf (not shown) to a carcase wall (which is also not shown), whereby the carcase wall may in this case be the side wall of a cupboard carcase, whilst in the exemplary embodiment described below in conjunction with FIGS. 9 to 13 it is constituted by a frame element which projects from a side wall of the cupboard carcase and which narrows the door opening with respect to its unobstructed breadth. The hinge 10 itself has a support wall fastening member, which is constructed as a short support arm 12 and which is coupled by means of two hinge guides 14 and 16, which are pivotally connected to its end directed out of the interior of the carcase, to a door leaf fastening member, which is constructed as an insertion cup 18 and is to be fastened sunk into a recess in the associated door leaf and in whose interior the other ends of the hinge guides 14,16 are pivotally connected. The guides 14,16 thus constitute in the illustrated case a so-called four joint mechanism, whereby it should, however, be pointed out that this construction of the joint mechanism is not essential to the invention, i.e. that the hinge could be constructed e.g. as a single joint hinge or even as a knuckle joint hinge. The joint mechanism constituted by the hinge guides 14,16 and the door leaf fastening member, i.e. the insertion cup 18, are thus also not described in detail in the subsequent description—because they are not important in the context of the invention.

Of importance to the invention, on the other hand, is the construction of the support wall fastening member, i.e. the support arm 12 and the manner in which it is movably mounted on a mounting element 20, which for its part is secured to the inner surface of the side wall referred to above of a cupboard carcase, whereby e.g. a fastening by means of fastening screws (not shown) can be contemplated which may be screwed into bores in a front series of bores, i.e. on the side of the door leaf, which is provided essentially for receiving shelf bottom supports.

The support arm 12, which is produced for instance in a stamping-pressing method from metal plate, has a web surface 22, from whose two lateral longitudinal edges a respective cheek 24 is bent over downwardly at right-angles. The cross-section of the support arm thus corresponds to a U rotated through 180°, i.e. upside down. The hinge guides 14,16 are mounted at the end of the support arm 12 which is directed out of the interior of the carcase on hinge pins, whose opposite ends are fixed in bores 26,28 in the cheeks 24. Formed on the rear end edges of the cheeks 24 at the end directed into the interior of the carcase are strip-shaped corners (corner extensions) 30 directed inwardly at right-angles, i.e. towards one another, which, as described below, render possible a mounting of the support arm on the mounting member 20 which is adjustable in a direction extending at right-angles to the carcase side wall.

Stamped into the web surface 22 of the support arm 12 at a distance from the end in the interior of the carcase is a circular opening 32, through which the engagement end of a tool, e.g. the blade of a screwdriver, may be introduced into the slot in the head **34*a* of an adjusting screw 34 (FIG. 1), the diameter of the head 34*a* of the adjusting screw 34 being larger than the diameter of the opening 32. Machined into the rear end, which is extended somewhat into the interior of the carcase beyond the corners 30, of the web surface 32 is an elongate hole 36 which opens out into the interior of the carcase and through which, in the intended fastened position of the support arm 12 on the mounting member 20, passes the threaded shaft of a fastening screw 38, whose screw head 38*a* then engages the upper side of the web surface 22**.

Figure 3:
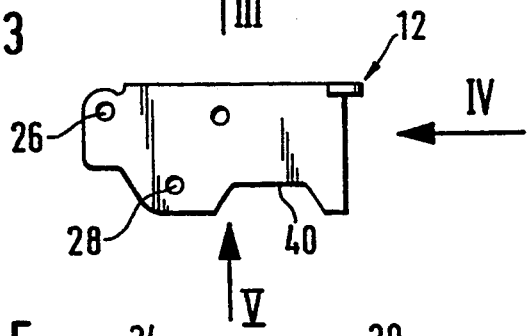
FIG. 3 is a side view of the support arm, seen in the direction of the arrow 3 in FIG. 2.
Figure 4:
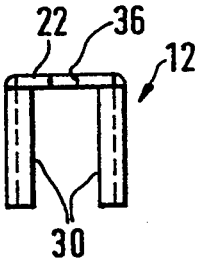
FIG. 4 is a rear view of the support arm, seen in the direction of the arrow 4 in FIG. 3.
Figure 5:
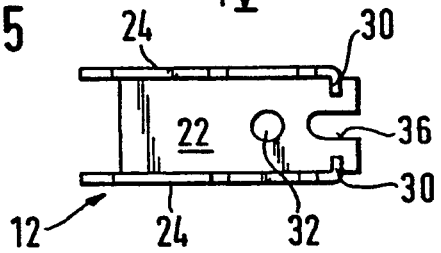
FIG. 5 is an underneath view of the support arm, seen in the direction of the arrow 5 in FIG. 3.
Figure 6:
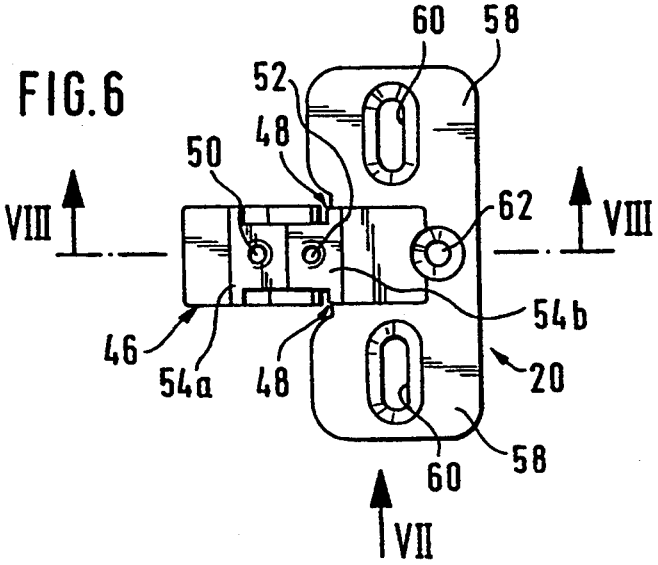
FIG. 6 is a plan view of the mounting member of the exemplary embodiment shown in FIG. 1, seen in the direction of the arrow 6 in FIG. 1.

The lateral cheeks 24 of the support arm 12 are not straight at their free edges directed towards the fastening surface but each have a cut-out 40 (FIGS. 1 and 3) in the region between the rear and front end.

Figure 7:
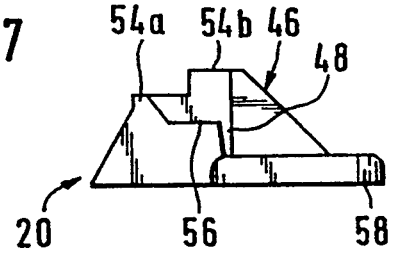
FIG. 7 is a side view of the mounting member, seen in the direction of the arrow 7 in FIG. 6.
Figure 8:
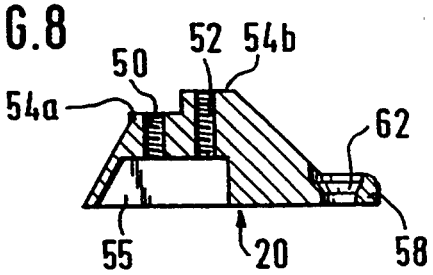
FIG. 8 is a sectional view through the mounting member, seen in the direction of the arrows 8—8 in FIG. 6.

The mounting member 20 shown in FIGS. 1,7 and 8 has a retaining block 46 which projects up and fits between the cheeks 24 of the support arm 12 and whose maximum breadth is thus approximately the same as the free distance between the inner surfaces of the cheeks 24. In order to receive the corners 30 of the support arm 12, upwardly open grooves 48 are provided in the side walls of the retaining block 46 in which the inserted support arm is form-lockingly retained against retraction in the direction out of the interior of the carcase and sliding in in the direction of the interior of the carcase. The adjustable fixing of the support arm 12 at right-angles hereto, i.e. in the longitudinal direction of the grooves—i.e. to adjust the degree of overlap or engagement of a door leaf connected to a cupboard carcase with the hinge 10—is effected by the aforementioned screws, i.e. the adjusting screw 34 and the fastening screw 38, which may be screwed into associated threaded bores 50 and 52 in the retaining block 46. The retaining block 46 of the mounting member 20 has two vertically offset sections **54*a* and 54*b* in its upper surface directed towards the web surface, whereby the bore 52 for the fastening screw 38 is provided in the section 54*b* which is of greater height and positioned further within the interior of the carcase and the threaded bore 50 for the adjusting screw is provided in the section 54*a* which is lower by about the amount of the height of the head of the adjusting screw 54. The threaded bores 50 and 52 extend through the retaining block 46 into a recess 55 (FIG. 8) provided in the underside of the retaining block so that a large screwing-in depth and accordingly a relatively large movement path is available for the relatively long threaded shafts of the screws 34 and 38**.

As already explained, the diameter of the head **34*a* is larger than the diameter of the stamping 32 in the web surface 22 of the support arm so that the web surface thus comes into engagement with the head screwed into the threaded bore 50 when the corners 30 of the support arm are slid into the grooves 48 in the retaining block 46. The extent to which the adjusting screw 34 is screwed in thus determines the extent to which the support arm may be slid onto the retaining block down to its lower surface or the fastening surface on the cupboard carcase. The support arm is then held against being pulled away by the fastening screw 38 which passes through the elongate hole 36 and which is screwed in in order to fix the support arm to the mounting member 20 until its head 38*a* rests laterally adjacent the elongate hole 36 on the upper side of the web surface 22. When the fastening screw 38 is loosened, a change in the insertion depth of the support arm 12 into the grooves 48 is possible by rotating the head of the adjusting screw 34 through the stamping 32** in the screwing-in or unscrewing direction. By retightening the fastening screw the support arm is then fixed in the altered set position.

In order to be able to mount the support arm of the hinge 10, which has been premounted on the door leaf, onto the mounting member 20 when the fastening screw has been preinstalled, the possibility is provided of being able to slide the rear end of the web surface 22 in the region of the elongate hole 36, when the fastening screw 38 is screwed upwardly, beneath the head **38*a* of the fastening screw before the corners 30 are slid into the grooves 48**.

For this purpose, the grooves 48 in the mounting member 20 extend only over a proportion of the height of the retaining block 46, that is to say from the fastening surface to about half-way up the retaining block due to the fact that the side limiting wall of the groove closer to the joint mechanism extends only about half-way up the mounting block 46 and then the mounting member is reduced at that point by the removal of material from the side surfaces of the mounting member in the upper lateral regions 56 to a breadth which is substantially the same as or somewhat smaller than the unobstructed spacing between the free limiting edges pointing towards one another of the corners 30 of the support arm 12. It is thereby possible to slide the lower edges of the corners 30 from above onto the regions 56 of reduced breadth and then to slide the support arm until engagement of the corners with the rear lateral limiting wall of the groove 48 further from the joint mechanism, which extends over the entire height of the retaining block 46, whereby the shaft of the fastening screw 38 passes into the elongate hole 36 and the fastening screw is then tightened after introduction of the corners 30 into the grooves 48 and the support arm 12 can thus be screwed down until it is in engagement with the head of the adjusting screw 34. In order to disassemble the retaining arm, the reverse sequence may be followed, i.e. the fastening screw 38 is unscrewed until the corners 30 can be withdrawn so far upwardly out of the grooves 48 that their lower edges come into the lateral regions 56 of the retaining block 46 which are of reduced breadth, whereafter the support arm 12 can be withdrawn forwardly, i.e. in the direction out of the interior of the carcase, without the fastening screw 38 being completely unscrewed.

In order to fasten the the carcase member 20 to the associated side wall of the cupboard carcase, flat fastening flanges 58 are provided at the lower side surface regions close to the fastening surface of the retaining block 46 which project in opposite directions and in which a respective through opening constructed as a countersunk elongate hole 60 is provided for fastening screws which may be screwed into the fastening surface or into fastening bores provided in it. Due to the construction of the through openings as elongate holes 60, vertical adjustment, predetermined by the length of the elongate holes 60, of the mounting member and thus of a door leaf connected with the hinge 10 in accordance with the invention to a cupboard carcase is possible. Additionally provided in the flat section of the fastening flanges which connects the two fastening flanges 58 in the interior of the carcase is a further countersunk bore 62, into which a further fastening screw may be screwed. Since this bore 62 is of circular shape, the fastening screw screwed into it fixes the vertical position of the mounting member 20 even when the fastening screws passing through the elongate holes 60 have been loosened.

In the modified exemplary embodiment shown in FIG. 9 of a hinge 110 constructed in the inventive manner, the actual hinge, i.e. the support arm 12 connected via the joint mechanism 14,16, to the insertion cup 18, corresponds to the exemplary embodiment described in conjunction with the preceding figures of the drawings so that only the modified mounting member 120 need thus be described in detail below whilst it is in other respects sufficient to refer to the preceding description, particularly as the same reference numerals are associated with functionally corresponding components of the two exemplary embodiments in the drawings, whereby merely in the case of the second exemplary embodiment of the hinge 110 a "1" is placed in front. This applies also to functionally corresponding constructions of the mounting members 20 and 120 so that in this respect only the differences which have been made need to be described.

The essential difference in the two mounting members resides in that the grooves 148 in the retaining block 146, which receive the corners of the support arm 112, extend over the entire height of the retaining block, whose breadth corresponds over its entire length to the unobstructed spacing between the cheeks 124 of the support arm 112, which means that the corners of the support arm 112 must be guided to above the upper opening of the grooves 148 during mounting onto the mounting member 120. Since the threaded shaft of the fastening screw 138 cannot be so long that it can be screwed out for the mounting procedure by the full extent of the height of the support arm 112—when screwing in, the threaded shaft would then penetrate additionally into the material of the carcase—the fastening screw 138 is not screwed directly into the retaining block 146 but into a cylindrical receiving member 164 (FIGS. 12 and 13), which for its part is mounted in the mounting member 146 so as to be pivotable about an axis extending at right-angles to the longitudinal axis of the support arm and parallel to the carcase fastening surface and has a threaded bore 152 for the shaft of the fastening screw 138 which passes radially through it approximately centrally. As a result of a recess 166 of adequate breadth (FIGS. 10 and 12), which passes through to the upper surface of the retaining block 146 and is open to the interior of the carcase, it is possible to screw the fastening screw 138 into the threaded bore 152 and to swing its head **138*a*, for the purpose of mounting the support arm, so far rearwardly, i.e. into the interior of the carcase, that the threaded shaft comes out of the elongate hole 136 in the web surface 122 of the support arm and the support arm 112 can be pushed onto the retaining block 146 without being impeded by the screw or can be withdrawn from it. In order to render this swinging movement possible, the fastening screw must be unscrewed by only a small amount from its fastened position in which it presses firmly againt the web surface 122**.

The fastening flanges 158 are provided in the mounting member 20 offset further forwardly towards the joint mechanism end and projecting laterally from the retaining member 146 and project somewhat beyond this front end. At the front edge the fastening flanges 158 each have at least one low abutment 168 which, in the predetermined fastened position of the mounting member 120, engage the carcase surface opposed to the inner surface of the closed door leaf. Since the mounting member 120 is intended for mounting the hinge on the end surfaces of a frame which narrows the free opening of the cupboard carcase, the position of the retaining block 146 on the end surface of the frame in relation to its front side directed towards the door leaf is determined by abutments 168.

It will be apparent that modifications and developments of the described exemplary embodiments may be realised within the scope of the inventive concept. Thus, for instance, the mounting member which, in the described exemplary embodiments, is manufactured from die cast metal, can also be manufactured of plastics material, conveniently of fibre reinforced plastics material. The fastening flanges 158 should then be of increased thickness with respect to that shown in the drawings in order to achieve sufficient strength.

We claim:

1. Furniture hinge having a door fastening member, which door fastening member is constructed as an insertion cup which is mountable in a recess in the inner surface of a door to be secured to a furniture carcase, the door fastening member being coupled via a joint mechanism to a carcase fastening member which is constructed as a support arm movably securable to a mounting member secured to the furniture carcase, wherein at least a portion of the support arm laterally fittingly engages over the mounting member by way of a web surface of the support arm having a U-shaped cross-section, said web surface comprising a pair of opposing spaced-apart cheeks, the cheeks having narrow, strip-shaped corner extensions which are bent over substantially at right-angles towards one another from limiting edges of the cheeks, which limiting edges face away from the insertion cup, the cheeks extending at right-angles to a carcase fastening surface of the mounting member, whereby the cheeks laterally engage over the mounting member, which corner extensions are each slidable into a conforming groove provided in the mounting member and which grooves are open at an upper end thereof directed away from the carcase, an adjusting screw residing within an associated threaded bore in the mounting member is provided for adjusting the spacing of the support arm from the carcase fastening surface, the web surface of the support arm bearing on a free end of the adjusting screw, a fastening screw passed through an opening in the web surface of the support arm into the mounting member is provided for fixing the support arm, a head of which fastening screw is tightenable against an outer surface of the support arm web surface directed away from the mounting member, wherein the opening through which the fastening screw (38;138) passes is constructed as an elongate hole (36;136) which is open at the end of the web surface which is directed away from the insertion cup and points into an interior of the carcase, and that the length of the grooves (48;148) in the mounting member (20;120), which grooves receive the corner extensions (30;130), and the length of a shaft of the fastening screw (38;138) are so matched to one another that the fastening screw (38;138) may be screwed so far out of an associated threaded bore (52;152) in the mounting member (20;120), without complete removal of the shaft from the bore, that an adequate clearance for removal of the support arm (12;112) from the mounting member (20;120) is produced between an upper side of the support arm web surface (22;122) and an associated underside of the head (**38*a*;138*a*) of the fastening screw (38;138**).

2. Furniture hinge as claimed in claim 1, wherein the mounting member (20) has a largest height corresponding to a largest free height of the cheeks (24) measured from a free end of said limiting edge thereof to an under side of the web surface (22) and that the upper surface of the mounting member (20) directed towards the web surface has two vertically offset sections (**54*a*;54*b*), a first of which sections (54*b*) corresponds to the full height of the mounting member, whereby the threaded bore (52) for the fastening screw (38) opens out in the first section (54*b*) and the threaded bore (50) for the adjusting screw (34) opens out in a second of said offset sections (54*a***) being of lesser height than the first section.

3. Furniture hinge as claimed in claim 2, wherein the height difference between the two offset sections (**54*a*;54*b*) is approximately equal to the height of a head (34*b*) of the adjusting screw (34**).

4. Furniture hinge as claimed in claim 2, wherein the grooves (48) in the mounting member (20) extend only over a portion of the height of the mounting member, in that an inner groove wall (48) further from the joint mechanism extends over the full height of the mounting member (20) while an outer groove wall nearer to the joint mechanism passes only partially up to the height of the mounting member and portions (56) of the mounting member (20) located above the outer groove walls on side surfaces of the mounting member are characterized by a reduced breadth of the mounting member, the reduced breadth being substantially equal to or somewhat smaller than the unobstructed distance measured between the free lateral limiting edges of the corner extensions (30) of the support arm (12) pointing towards one another.

5. Furniture hinge as claimed in claim 4, wherein the portion (56) of reduced breadth of the mounting member (20) extends towards a front end region of the mounting member (20) facing out of the interior of the carcase, wherein in the front end region, the mounting member (20) is broadened over its entire height to a full breadth corresponding approximately to the unobstructed distance between interior faces of cheeks (24) of the support arm (12).

6. Furniture hinge as claimed in claim 1, wherein the grooves (148) in the mounting member (120) extend over the full height of the mounting member (120), and in a region between the grooves (148) the mounting member (120) has a recess (166) which passes through to the upper surface of the mounting member and is open to the interior of the carcase, and wherein a receiving member (164) with a threaded bore (152) for receiving the shaft of the fastening screw (138) is mounted in a lower region of the mounting member (120) adjacent the fastening surface and within the recess (166) so as to be pivotable about an axis extending at right-angles to the longitudinal axis of the support arm and parallel to the carcase fastening surface.

7. Furniture hinge as chimed in claim 1, wherein the mounting member (20;120) has flat fastening flanges (58;158) projecting laterally from its lower side surface regions adjacent the fastening surface, the flanges having respective through openings for fastening screws screwable into the fastening surface.

8. Furniture hinge as claimed in claim 7, wherein the through openings have the shape of elongate holes (60;160).

9. Furniture hinge as claimed in claim 8, wherein the elongate holes (60;160) extend at right-angles to the central longitudinal axis of the support arm (12;112).

10. Furniture hinge as chimed in claim 7, wherein the fastening flanges (160) are arranged on a front end of the mounting member located toward the joint mechanism, said front end comprising a retaining block for engaging between the cheeks (124) of the support arm (112), and which fastening flanges project beyond the front end, at least one abutment (168) is provided in a region of a front limiting edge of the fastening flanges located toward the joint mechanism (160), said abutment extending at right-angles to a plane of the fastening flanges and is directed towards the fastening surface, whereby in the predetermined fastened position of the mounting member (120), the abutment engages a carcase surface opposed to an inner surface of an associated closed door leaf.

11. Furniture hinge as claimed in claim 7, wherein the cheeks (24;124) of the support arm (12;112) are each provided with a cut-out (40;140) of reduced height on their lower edges directed away from the web surface, said cut-out being located between said limiting edges of the cheeks and front section thereof carrying pins of the joint mechanism.

* * * * *